US009285093B2

(12) United States Patent
Simchak

(10) Patent No.: US 9,285,093 B2
(45) Date of Patent: Mar. 15, 2016

(54) SELF-LOCATING LIGHT SOURCE MODULE

(71) Applicant: Federal-Mogul Corporation, Southfield, MI (US)

(72) Inventor: Jeffrey Simchak, Dexter, MI (US)

(73) Assignee: Federal-Mogul Corporation, Southfield, MI (US)

( * ) Notice: Subject to any disclaimer, the term of this patent is extended or adjusted under 35 U.S.C. 154(b) by 146 days.

(21) Appl. No.: 13/844,536

(22) Filed: Mar. 15, 2013

(65) Prior Publication Data

US 2014/0268842 A1 Sep. 18, 2014

(51) Int. Cl.

| | |
|---|---|
| ***F21S 8/10*** | (2006.01) |
| ***F21V 19/00*** | (2006.01) |
| ***H01R 33/975*** | (2006.01) |

(52) U.S. Cl.

CPC ..... *F21S 48/212* (2013.01); *F21S 48/1109* (2013.01); *F21V 19/0035* (2013.01); *H01R 33/975* (2013.01)

(58) Field of Classification Search

CPC ... F21S 48/211; F21S 48/212; F21S 48/1104; F21S 48/1109; F21S 48/1122; F21V 19/003; F21V 19/0035; F21V 19/004; F21V 19/0045; H01R 33/975; H01R 33/9753; H01R 33/9756

USPC ..... 362/487, 548, 549, 652–659

See application file for complete search history.

(56) References Cited

U.S. PATENT DOCUMENTS

| | | | | |
|---|---|---|---|---|
| 1,568,875 | A | 1/1926 | Camblin | |
| 1,604,839 | A | 10/1926 | Amidon | |
| 2,061,000 | A | 11/1936 | Michel et al. | |
| 3,614,712 | A * | 10/1971 | Taormina et al. | 439/549 |
| 4,009,966 | A | 3/1977 | Craig | |
| 4,533,984 | A | 8/1985 | Gatton | |
| 4,984,136 | A | 1/1991 | Yamagishi et al. | |
| 5,017,327 | A * | 5/1991 | Bamber | F21V 19/02 362/289 |
| 5,032,758 | A | 7/1991 | Davenport et al. | |
| 5,060,120 | A | 10/1991 | Kobayashi et al. | |

(Continued)

FOREIGN PATENT DOCUMENTS

| | | | |
|---|---|---|---|
| CN | 201448665 | U | 5/2010 |
| EP | 2108885 | A1 | 10/2009 |

(Continued)

OTHER PUBLICATIONS

International Search Report for application No. PCT/US2014/026047, dated Jun. 30, 2014, 3 pages.

(Continued)

*Primary Examiner* — Alan Cariaso

(74) *Attorney, Agent, or Firm* — Reising Ethington P.C.

(57) ABSTRACT

A self-locating light source module for an automotive lamp assembly having a reflector and housing to which the module is mounted. The light source module includes a socket and a light source holder captively retained in an aperture of the socket. The light source holder can undergo limited movement relative to the socket along a plurality of axes, including a central axis of the socket. The light source holder and central passage in the reflector having complementary tapered surfaces with the holder being biased into engagement with the passage such that the tapered surfaces and permitted relative movement of the holder allow the light source to self-locate at the desired position within the reflector.

15 Claims, 3 Drawing Sheets

(56) References Cited

U.S. PATENT DOCUMENTS

| | | | | |
|---|---|---|---|---|
| 5,215,371 | A | 6/1993 | Pileski | |
| 5,327,330 | A | 7/1994 | Van Oel et al. | |
| 5,795,056 | A | 8/1998 | Seiger | |
| 5,855,430 | A * | 1/1999 | Coushaine et al. | 362/519 |
| 6,062,709 | A | 5/2000 | Cunnien et al. | |
| 6,116,755 | A * | 9/2000 | Ichihara et al. | 362/267 |
| 6,152,584 | A | 11/2000 | Tsukamoto | |
| 6,176,604 | B1 * | 1/2001 | Dubrovin | F21S 48/1109 362/265 |
| 6,183,106 | B1 | 2/2001 | Thummel et al. | |
| 6,276,812 | B1 * | 8/2001 | Helbig et al. | 362/655 |
| 6,328,455 | B1 * | 12/2001 | Helbig | 362/657 |
| 6,734,632 | B2 * | 5/2004 | Yamaguchi | 315/57 |
| 6,866,407 | B2 * | 3/2005 | Park | 362/508 |
| 6,976,776 | B2 * | 12/2005 | Kakidaira et al. | 362/548 |
| 7,052,165 | B2 | 5/2006 | Field | |
| 7,093,964 | B2 | 8/2006 | Bynum | |
| 7,220,029 | B2 | 5/2007 | Bynum et al. | |
| 7,334,914 | B2 | 2/2008 | Maglica | |
| 7,690,825 | B2 | 4/2010 | Kuwahara et al. | |
| 7,736,038 | B2 | 6/2010 | Suzuki | |
| 8,066,416 | B2 | 11/2011 | Bucher | |
| 8,616,744 | B2 * | 12/2013 | Uchiyama et al. | 362/548 |
| 8,807,808 | B2 * | 8/2014 | Boyd et al. | 362/514 |
| 2002/0186567 | A1 | 12/2002 | Brown | |
| 2005/0218774 | A1 | 10/2005 | Bhagwat | |
| 2009/0161380 | A1 | 6/2009 | Narumi | |
| 2010/0135036 | A1 | 6/2010 | Matsuba et al. | |
| 2011/0141756 | A1 | 6/2011 | Uchiyama et al. | |
| 2012/0069593 | A1 | 3/2012 | Kishimoto et al. | |

FOREIGN PATENT DOCUMENTS

| | | | | |
|---|---|---|---|---|
| GB | 1524226 | A * | 9/1978 | F21S 48/1104 |
| JP | 2001525592 | A | 12/2001 | |
| JP | 2002531917 | A | 9/2002 | |
| JP | 2003157704 | A | 5/2003 | |
| KR | 200325474 | Y1 | 9/2003 | |

OTHER PUBLICATIONS

Written Opinion for application No. PCT/US2014/026047, dated Jun. 30, 2014, 5 pages.

* cited by examiner

SELF-LOCATING LIGHT SOURCE MODULE

TECHNICAL FIELD

This invention generally relates to automotive lamp assemblies and, in particular, to lamp assemblies that include a reflector and a light source-supporting housing that are substantially fixed in position relative to each other when mounted to a vehicle.

BACKGROUND

Exterior lamp assemblies for automotive vehicles generally include a light source and reflector for redirecting at least a portion of the light from the light source in a desired direction. In most reflector-type lamp assemblies, it is desirable to position the light source at or close to a focal point of the reflector so that rearward radiated light from the light source is reflected in a direction parallel to the optical axis of the reflector. Commonly, these lamp assemblies include a housing or other support member having a lamp socket in which the light source is mounted, with the housing and its socket and light source being installed such that the light source extends through a passage or thruway in the back of the reflector to position the light source at the focal point of the reflector. However, due to manufacturing tolerances and/or when the reflector and housing are mounted at least somewhat independently in a substantially fixed position relative to each other, it can be difficult to accurately locate the light source within the reflector since the socket help by the housing may not be accurately aligned with the thruway in the reflector.

SUMMARY

According to one embodiment, there is provided a light source module for an automotive lamp assembly that includes a socket having an aperture located about a central axis of the socket, and a light source holder captively retained within the socket and extending out of the socket through the aperture. The light source holder can undergo limited movement relative to the socket along a plurality of axes, including the central axis of the socket. The light source holder is also biased in a direction along the central axis and away from the socket such that a positive force applied to the light source holder against the bias forces the light source holder at least partially into the socket.

According to another embodiment, there is provided a light source module for an automotive lamp assembly that includes a light source holder with a proximal end coupled to a socket and a distal end having an outer surface complementary to an inner surface of a reflector. The complementary surfaces of the light source holder and the reflector are configured for engagement with each other to position a light source at a desired location within the reflector.

According to yet another embodiment, there is provided self-locating light source module for use in an automotive lamp assembly having a housing and a reflector that are substantially fixed in position relative to each other when mounted to a vehicle such that the light source module mounts to the housing and engages a passage of the reflector to thereby position a light source within the reflector. The light source module includes: a socket having terminals for conducting externally-supplied electrical power through the light source module to a light source; and a light source holder that receives the light source. The light source holder is captively retained in the socket and is able to undergo limited movement along a plurality of axes relative to the socket. The light source holder has an external surface portion wherein, when the light source module is mounted to the housing and then assembled to the reflector during installation, the external surface portion engages the reflector at the passage to position the light source at a desired location within the reflector, with the light source holder being able to undergo movement along one or more of the axes relative to the socket during positioning of the light source at the desired location.

BRIEF DESCRIPTION OF THE DRAWINGS

Preferred exemplary embodiments will hereinafter be described in conjunction with the appended drawings, wherein like designations denote like elements, and wherein.

DETAILED DESCRIPTION OF EXEMPLARY EMBODIMENTS

The automotive lamp assembly described herein is capable of positioning a light source at a desired location within a reflector, even when the reflector and the housing to which the light source is mounted are separately mounted in substantially fixed position relative to each other. In particular, the automotive lamp assembly includes a self-locating light source module that allows the light source to be coupled to the housing and, at the same time, capable of movement relative to the housing. In addition, the light source module and the reflector include complementary surfaces that are urged together during assembly to help position the light source at a desired location within the reflector.

Figure 1:
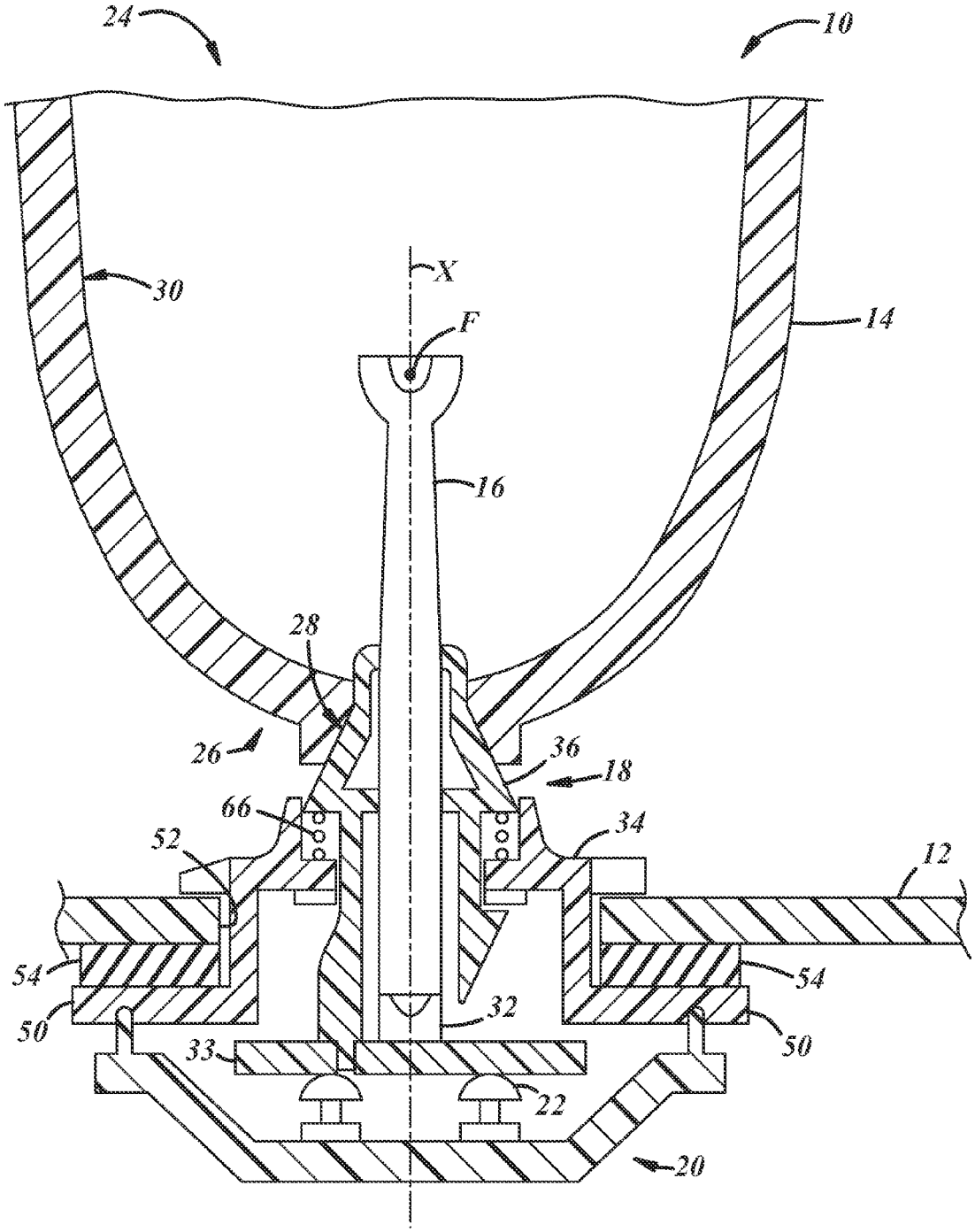
FIG. 1 is a schematic cross-sectional view of one embodiment of an automotive lamp assembly that includes a socket and a light source holder capable of positioning a light source at a desired location within a reflector.

FIG. 1 illustrates an automotive lamp assembly 10, according to one embodiment. The assembly 10 includes a housing 12, a reflector 14 for receiving a light source 16 therein, and a light source module 18 mounted to the housing 12 for positioning the light source 16 within the reflector 14. Electrical power may be supplied to the light source 16 via a base 20 that includes one or more terminals 22. The lamp assembly 10 is adapted for attachment to a vehicle so that light from the light source 16 can provide illumination from the vehicle. Such illumination may be forward lighting (headlights, etc.), signal lighting (turn signals, brake lights), marker lighting, or other.

The reflector 14 includes an optical axis X and, as used herein, the terms radially and axially refer to directions with respect to the optical axis X of the reflector 14. In particular, radially refers to a direction normal to the optical axis X (i.e., in a plane defined by Y and Z-axes), and axially refers to a direction parallel to the optical axis X. In addition, the reflector 14 has opposite front and back ends 24, 26, and a thruway 28 located at its back end 26 for receiving the light source 16 therethrough. The reflector 14 further includes a reflective and concave interior 30 that may be substantially rotationally symmetric about the optical axis X. The interior 30 of the reflector 14 may have an elliptical, parabolic, or other curved profile with a focal point F. It should be understood that the view shown in FIG. 1 is only one view and that other views, such as a top view, may show a different profile for the interior 30 of reflector 14 with a different focal point or no particular focal point. Though not explicitly shown in FIG. 1, the reflector 14 is typically closed off at the front end 24 to protect the inside of the reflector 14 from the environment. The housing 12, a lens, or a transparent wall may serve this function.

The light source 16 provides light inside the reflector 14, and is positioned at a desired location within the reflector 14 by the light source module 18. For example, the light source module 18 may be configured to position the light source 16 within the reflector 14 such that the light source 16 is located along the optical axis X of the reflector 14 and/or at or near the focal point F of the reflector 14. However, it should be understood that the light source module 18 can suitably be used to position a light source at a variety of different locations within the reflector 14. In addition, the light source 16 can be any source of light that is capable of illuminating the area in front of the vehicle, including halogen or other filament-based lamps, xenon-arc lamps, fluorescent sources, LEDs, or fiber optics, to name a few. In the embodiment shown in FIG. 1, the light source 16 is a light pipe, and receives light emitted from an LED 32 located outside the reflector 14. The LED 32 is mounted in electrical communication with a printed circuit board (PCB) 33, and also in electrical communication with the terminals 22 of the base 20. Terminals 22 may be spring loaded or otherwise configured to maintain contact with the PCB 33 regardless of the relative position of the light source holder and socket. For example, the PCB 33 may have surface contact pads having a large enough area that the apex of the rounded head terminals will maintain electrical contact with the pads regardless of the lateral (radial) positioning of the light source holder relative to the socket.

Figure 2:
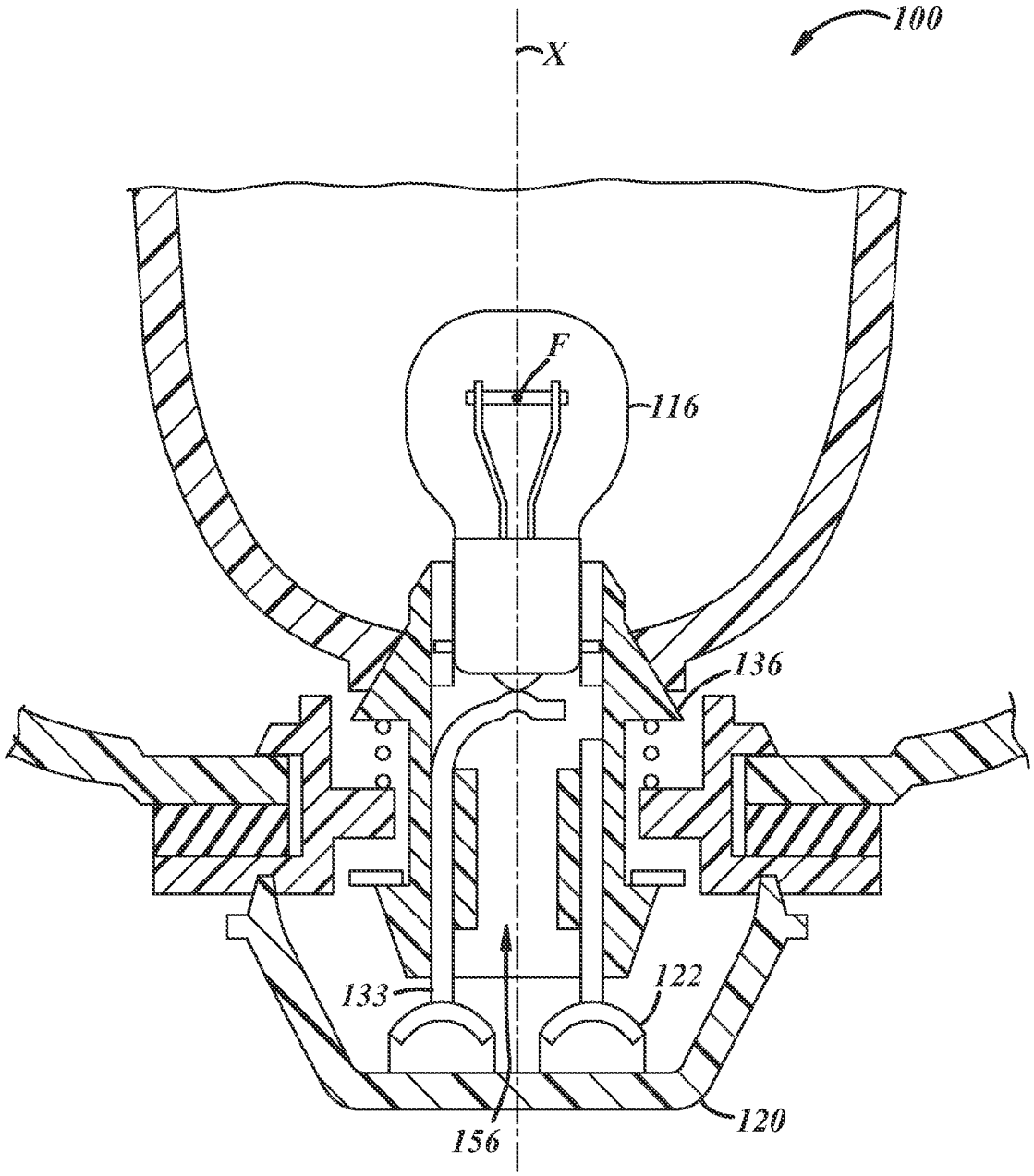
FIG. 2 is a schematic cross-sectional view of another embodiment of an automotive lamp assembly.
Figure 4:
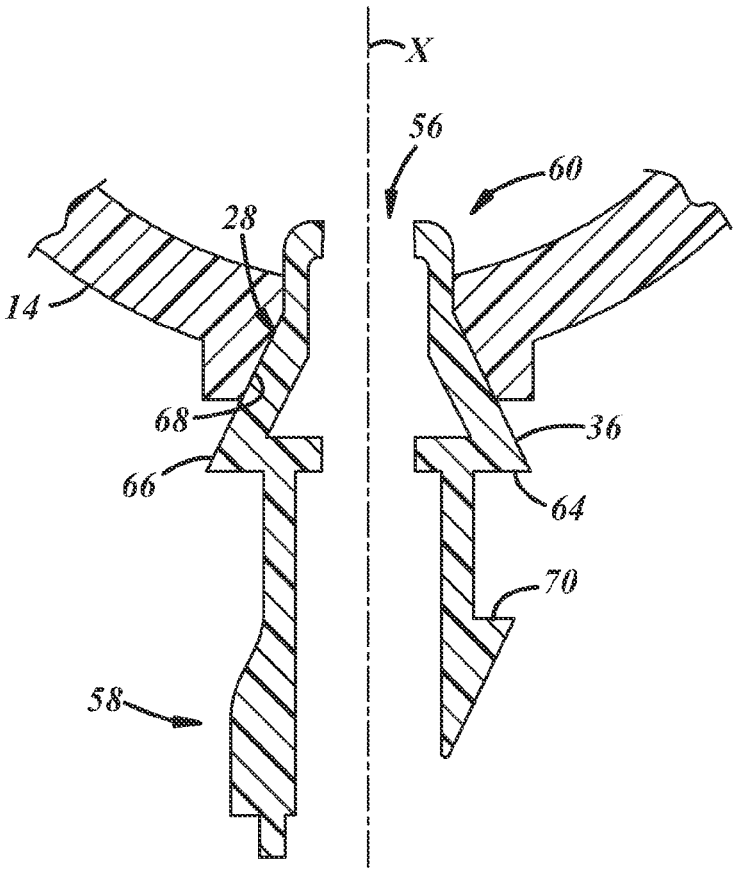
FIG. 4 is an enlarged view of the light source holder of FIG. 1.

FIG. 2 illustrates another embodiment of an automotive lamp assembly 100, wherein the light source 116 is a filament-based light bulb. In this embodiment, the light source 116 is electrically connected to the terminals 122 of the base 120 by an electrical connector 133 that extends partially into the central passageway 156 of the light source holder 136. The light source 116 in this embodiment can be easily removed from the light source holder 136 and replaced separately from the remaining components of the automotive lamp assembly 100.

The light source module 18 includes a socket 34 and a light source holder 36 that interact with each other to position the light source 16 at a desired location within the reflector 14. In particular, the socket 34 acts as a datum for the light source holder 36, and the light source holder 36 provides freedom of movement to the light source 16. Accordingly, the light source module 18 indirectly connects the light source 16 to the housing 12 such that the light source 16 can move relative to the housing 12 and thus can be positioned at a predetermined location within the reflector 14, regardless of the location of the reflector 14 relative to the housing 12. The light source module 18 disclosed herein can be used in a wide variety of automotive lamp assemblies including and in addition to the assemblies shown in the drawings. For example, the light source module 18 may suitably be used in tail lamp, headlamp, and turn-signal lamps, to name a few.

Figure 3:
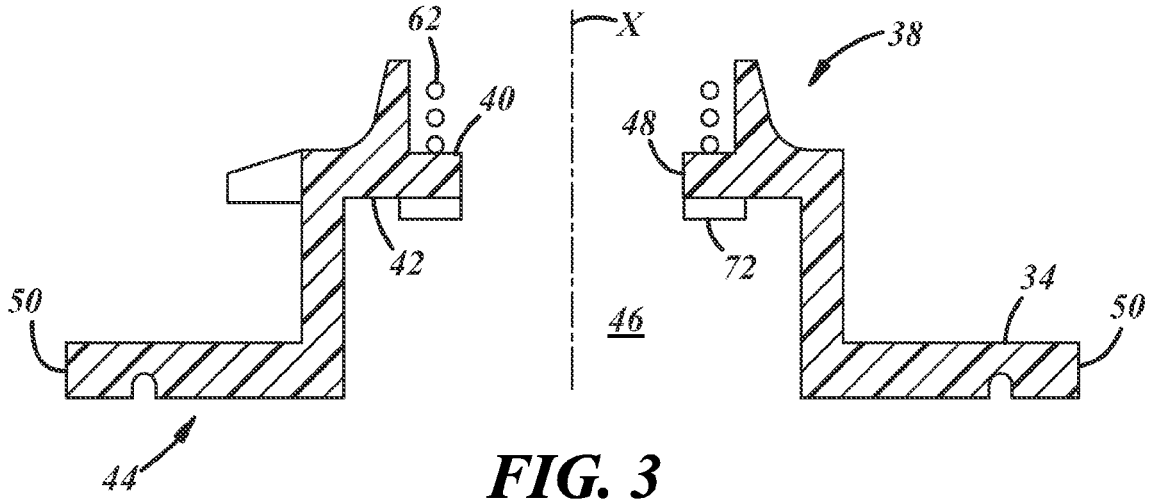
FIG. 3 is an enlarged view of the socket of FIG. 1.

The socket 34 indirectly connects the light source holder 36 to the housing 12. Referring now to FIG. 3, the socket 34 includes an upper portion 38 having front and back surfaces 40, 42, a lower portion 44, and an inner cavity 46. The upper portion 38 of the socket 34 includes an aperture 48 located normal to a central axis of the socket 36. In the embodiment shown in FIG. 1, the central axis of the socket 36 is aligned with the optical axis X of the reflector 14. In practice, however, the central axis of the socket 36 may or may not be located along the optical axis X of the reflector 14. The aperture 48 of the socket 34 is configured to receive a portion of the light source holder 36 and to captively retain such portion within the inner cavity 46 of the socket 34 such that a remaining portion of the light source holder 36 extends out of the socket 34 through the aperture 48. The lower portion 44 of the socket 34 includes radially extending tabs 50 for removably mounting the socket 34 within an opening 52 of the housing 12. For example, the opening 52 in the housing 12 may allow the tabs 50 to be inserted into the opening 52 when in a first position, but may prevent the tabs 50 from being removed after the tabs 50 have been rotated to a second position. An annular sealing member 54 may be positioned between the tabs 50 of the socket 34 and the housing 12 to allow for sealed installation of the socket 34 within the opening 52 of the housing 12.

The light source holder 36 carries the light source 16 and helps position the light source 16 within the reflector 14. The light source holder 36 has a generally elongated body with a central passageway 56 extending from a proximal end 58 to a distal end 60 thereof. The light source 16 is carried by the light source holder 36 such that a first end of the light source is located within the central passageway 56 of the holder and an opposite second end of the light source 16 extends out of the central passageway 56 and away from the distal end 60 of the holder 36. In this position, the first end of the light source is electrically interconnected to the terminals 22 of the base 20, and the second end of the light source is positioned to provide light to the interior 30 of the reflector 14.

When assembled, the distal end 60 of the light source holder 36 is forced into the thruway 28 of the reflector 12 so that the light source 16 is positioned within the interior 30 of the reflector 14 at a predetermined axial and radial location. The light source holder 36 and the reflector 14 are forced into engagement by a biasing member 62, e.g., a spring or other force-protruding feature(s), which is located between the upper portion 38 of the socket 34 and an overhanging portion 64 of the light source holder 36. The biasing member 62 exerts a positive force in an axial direction against the overhanging portion 64, which forces the light source holder 36 away from the socket 34 and toward the reflector 14. The specific position of the light source 16 within the reflector 14 is accomplished by providing the light source holder 36 and the reflector 14 with complementary surfaces. In the embodiment shown in FIG. 1, the distal end 60 of the light source holder 36 has a tapered external surface 66 that is complementary to a tapered internal surface 68 of the thruway 28 in the reflector 14. By configuring the light source holder 36 and the reflector 14 in this way, the light source holder 36 and the reflector naturally taper fit together due to the axially applied biasing force.

The proximal end 58 of the light source holder 36 couples the light source holder 36 to the socket 34 and captively retains the light source holder 36 within the aperture 48 of the socket 34. In particular, the proximal end 58 of the holder 36 includes a radially extending shoulder 70 that seats against the back surface 42 of the socket 34 when the proximal end 58 of the holder 36 is inserted into the socket 36 past the opening of the aperture 48 and thereby limits the axial range of movement of the holder 36. However, the light source holder 36 can still move in multiple radial directions relative to the socket 34 to compensate for a limited amount of radial misalignment between the central axis of the socket 34 and the optical axis of the reflector 14. Radial movement of the holder 36 will cause the shoulder 70 of the holder 36 to slide along the back surface 42 of the socket 34. A washer 72 or other similar device may be positioned between the shoulder 70 of the light source holder 36 and the back surface 42 of the socket 34 to allow for increased radial movement of the holder 36 within the aperture 48 of the socket 34.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A light source module for an automotive lamp assembly, comprising:

a socket having an aperture located about a central axis of said socket;

a light source holder captively retained in said socket and extending out of said socket through said aperture, said light source holder having a tapered external surface configured to engage a complementary feature of a reflector and being able to undergo limited movement relative to said socket along a plurality of axes, including said central axis of said socket; and a discrete biasing member that biases said light source holder in a direction along said central axis and away from said socket such that, when a positive force is applied to said light source holder against said biasing member, said positive force forces said light source holder at least partially into said socket.

2. A light source module as defined in claim 1, wherein said biasing member is configured to urge said light source holder away from said socket.

3. A light source module as defined in claim 1, wherein said biasing member is configured to urge said light source holder into engagement with a back end of the reflector.

4. A light source module as defined in claim 1, wherein said light source holder has a central passageway for receiving a light source.

5. A light source module as defined in claim 1, further comprising a seal for sealed installation of said socket into an opening of a housing.

6. A light source module as defined in claim 1, wherein said socket, said light source holder, and said discrete biasing member are configured to interact with one another to position a light source at a desired location within the reflector.

7. A light source module as defined in claim 1, further comprising terminals for supplying power to said light source holder independently of the relative position of said socket and said light source holder.

8. A light source module as defined in claim 1, wherein said light source holder includes a shoulder configured to seat against a back surface of said socket to retain said light source holder within said aperture of said socket while allowing said light source holder to move relative to said central axis.

9. A light source module for an automotive lamp assembly, comprising:

a socket;

a light source holder with a proximal end coupled to said socket and a distal end having an outer surface complementary to an inner surface of a reflector, wherein said light source holder is moveably coupled to said socket such that said light source holder is able to undergo limited movement relative to said socket; and a discrete biasing member connected between a portion of said socket and an overhanging portion of said light source holder, said biasing member acting between said portions of said socket and light source holder to bias said light source holder away from said socket;

wherein said complementary surfaces of said light source holder and the reflector are configured for engagement with each other to position a light source at a desired location within the reflector.

10. A light source module as defined in claim 9, wherein said biasing member biases said light source holder in a direction away from said socket and toward the reflector.

11. A light source module as defined in claim 10, wherein, when said light source module is assembled to the reflector during installation, said outer surface of said distal end of said light source holder and the inner surface of the reflector are urged into engagement with each other by said biasing member.

12. A self-locating light source module for use in an automotive lamp assembly having a housing and a reflector that are substantially fixed in position relative to each other when mounted to a vehicle such that the light source module mounts to the housing and engages a passage of the reflector to thereby position a light source within the reflector, the light source module comprising:

a socket having an inner cavity and an aperture located normal to a central axis thereof;

terminals for conducting externally-supplied electrical power through said light source module to a light source; and a light source holder that receives the light source, said light source holder being captively retained in said socket and being moveably coupled to said socket such that said light source holder is able to undergo limited movement along a plurality of axes relative to said socket;

said light source holder having an external surface portion wherein, when said light source module is mounted to the housing and then assembled to the reflector during installation, said external surface portion engages the reflector at the passage to position the light source at a desired location within the reflector.

13. A light source module as defined in claim 1, wherein said socket includes an upper portion and a lower portion, with said upper portion having front and back surfaces, and said light source holder has a proximal end and a distal end, with said tapered external surface of said light source holder being located at said distal end of said light source holder.

14. A light source module as defined in claim 13, wherein said discrete biasing member is located between said front surface of said upper portion of said socket and an overhanging portion of said light source holder.

15. A light source module as defined in claim 14, wherein said overhanging portion of said light source holder has a surface that engages said discrete biasing member and that faces toward said front surface of said upper portion of said socket and toward said proximal end of said light source holder.

* * * * *